US007850517B2

(12) United States Patent
Lind et al.

(10) Patent No.: US 7,850,517 B2
(45) Date of Patent: Dec. 14, 2010

(54) ELECTRONIC LOTTERY SYSTEM FOR INCREASING THE USAGE OF TICKETS IN A LOTTERY GAME

(75) Inventors: Clifton E. Lind, Austin, TX (US); Jefferson C. Lind, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 1276 days.

(21) Appl. No.: 11/184,630

(22) Filed: Jul. 19, 2005

(65) Prior Publication Data

US 2007/0021163 A1 Jan. 25, 2007

(51) Int. Cl.
*A63F 9/24* (2006.01)

(52) U.S. Cl. ..... 463/17; 463/42

(58) Field of Classification Search ..... 463/1–21, 463/25

See application file for complete search history.

(56) References Cited

U.S. PATENT DOCUMENTS

| | | | | |
|---|---|---|---|---|
| 4,652,998 | A | 3/1987 | Koza et al. | |
| 5,042,809 | A | 8/1991 | Richardson | |
| 5,324,035 | A * | 6/1994 | Morris et al. | 463/42 |
| 5,788,237 | A | 8/1998 | Fults et al. | |
| 5,871,398 | A | 2/1999 | Schneier et al. | |
| 6,183,361 | B1 | 2/2001 | Cummings et al. | |
| 6,203,011 | B1 | 3/2001 | Nulph | |
| 6,241,606 | B1 | 6/2001 | Riendeau et al. | |
| 6,309,298 | B1 | 10/2001 | Gerow | |
| 6,358,151 | B1 * | 3/2002 | Enzminger et al. | 463/43 |
| 6,398,646 | B1 | 6/2002 | Wei et al. | |
| 6,402,614 | B1 | 6/2002 | Schneier | |
| 6,733,385 | B1 | 5/2004 | Enzminger et al. | |
| 2001/0004609 | A1 | 6/2001 | Walker et al. | |
| 2001/0036855 | A1 | 11/2001 | DeFrees-Parrott et al. | |
| 2002/0094859 | A1 | 7/2002 | Hirsch et al. | |
| 2004/0224770 | A1 * | 11/2004 | Wolf et al. | 463/42 |
| 2006/0148552 | A1 * | 7/2006 | Malle et al. | 463/17 |
| 2006/0234791 | A1 * | 10/2006 | Nguyen et al. | 463/16 |

* cited by examiner

*Primary Examiner*—Ronald Laneau
*Assistant Examiner*—Justin Myhr
(74) *Attorney, Agent, or Firm*—Russell D. Culbertson; Hathan H. Calvert; Dr. JP Cody

(57) ABSTRACT

A lottery gaming system utilizes one or more distribution groups of game play records. The gaming system preferably distributes a distribution group of game play records to each of a number of assignment components in the gaming system. Various ones of the play records are assigned from a distribution group in response to game play requests from respective players. The game play records that remain unassigned after a collection condition is met are collected and used to form a new distribution group available for re-distributing to an assignment component in the gaming system.

20 Claims, 4 Drawing Sheets

ELECTRONIC LOTTERY SYSTEM FOR INCREASING THE USAGE OF TICKETS IN A LOTTERY GAME

TECHNICAL FIELD OF THE INVENTION

This invention relates to games of chance, and, more particularly, to increasing usage of lottery tickets by reusing unassigned electronic lottery ticket records. The invention includes a gaming method and a gaming apparatus. The invention also encompasses a program product for implementing the gaming method.

BACKGROUND OF THE INVENTION

Lottery games have become popular in many jurisdictions in the United States and elsewhere. Lottery games are played with a set (sometimes referred to as a game set) of predefined tickets or game play records that are each associated with a particular result in the game. Some of the predefined tickets or game play records are each associated with a respective winning result and thus represent winning tickets/game play records. Other predefined tickets or game play records in the game set are each associated with a respective losing result and thus represent losing tickets/game play records. Since the set of tickets or game play records making up a lottery game has a predefined number of tickets or game play records and predefined number of winning and losing tickets/records, the set has a predefined payout to players and predefined hold for the game operator. That is, assuming that all tickets or game play records in the game set are sold, both the cumulative payout to the players and the cumulative value in from ticket or game play record sales are known.

Traditional lottery games are played with a paper lottery ticket. These paper lottery tickets are commonly printed with graphics consistent with a theme of the game. The printed material for each respective ticket includes some result indicator that is correlated to, or indicates, the result associated with the respective ticket. These result indicators are commonly covered or obscured at the time the ticket is sold. Once the player obtains the ticket, he or she may remove the cover or obscuring material to reveal the result indicator and thus the result associated with the ticket.

The paper tickets in a traditional lottery game are commonly produced at some manufacturing facility in books of tickets, each made up of a continuous roll of individual tickets or a continuous fan fold stack of individual tickets with the individual tickets separated by perforations or break lines. Typically, a lottery game set will include a very large number of tickets, and the ticket books produced at the manufacturing facility each include only a fraction of the total tickets that make up a complete lottery game. The tickets are randomly ordered in the ticket books and are sold and distributed sequentially from the randomized book of tickets so that the results in the lottery game are distributed to players in a random order unknown to the players or ticket sellers.

Lottery games have been implemented in electronic form in which each ticket is represented by an electronic data structure rather than a physical paper ticket. An electronic data structure correlating to a respective chance in a lottery-type game will be referred to further in this disclosure and accompanying claims as a "game play record." These game play records may take on a number of different forms. On one end of the spectrum, each game play record includes a result indicator, record identifier, and data that defines graphics that are used to display the result of the game play record to the player. At the other end of the spectrum, each game play record may include only a result indicator, and perhaps a record identifier, a table identifier, and a prize value. Regardless of the particular form of data structure used for the individual game play records, the game play records are commonly grouped in data files analogous to books of paper tickets and distributed in some random order from the file. Since the game play records are arranged in data files, the random distribution may be performed by randomizing the order of game play records in the respective data file and then distributing the game play records sequentially in that random order, or the game play records can be ordered in the data files and distributed randomly from the files.

The electronic lottery games may be implemented with a gaming system that includes a central processing system for storing different files that each contain some number of game play records and are analogous to books of physical lottery tickets. The central processing system distributes either individual game play records or game play record files to player stations which are in communication with the central processing system. In some cases, an intermediate component may receive game play record files from the central processing system and then communicate game play records to the player stations. The player stations include a display device for displaying information to the player, an arrangement for accepting wagers, an arrangement for receiving inputs from the player, and in some cases, an arrangement for storing game play record files containing some number of individual game play records. In this example electronic lottery system, a player enters the lottery game by making a game play request at a player station. In response to a game play request entered by the player, either the central processing system or an intermediate component (or the player station itself where the player station stores game play record files) assigns a particular game play record for the game play request. Where the central processing system or intermediate component is responsible for assigning individual game play records for game play requests, the central processing system or intermediate component also communicates to the player station either the assigned game play record or result information from the assigned game play record. Regardless of which system component is responsible for assigning the game play record for a given game play request, the player station ultimately displays the result associated with the game play record assigned to the player.

U.S. Pat. No. 6,241,606 to Riendeau et al. discloses a lottery-type gaming system in which electronic lottery game play records are created for a game and divided into two batches, with each batch being further divided into a distribution portion and an exchange pool. Groups of electronic game play records referred to as "packs" are then defined from the distribution portions and downloaded to distribution terminals. Each distribution terminal uses its respective packs of electronic game play records for satisfying game play requests entered at that terminal. At the end of some accounting period at a respective distribution terminal, information on game play records remaining unused at the distribution terminal is communicated back to a central processing system. The unused game play records are then collected with the respective exchange pool of undistributed game play records. Game play records from the exchange pool and unused but previously distributed game play records are then used to make additional distribution packs of game play records that are downloaded to distribution terminals for use in satisfying game play requests in some subsequent accounting period. Once there are not enough electronic game play records in the exchange pool to create another day's distribution portion from which the "packs" are created, the game is closed and final statistics are generated showing tickets sold, tickets remaining, pay-outs, etc.

It will be noted that where all of the lottery tickets/game play records for a lottery game are not sold, the results of the game will differ from the intended design of the game. That is, the total sales for the game will be lower than the total designed for the game. The total hold and payout may be higher or lower depending upon the results associated with the unused lottery tickets/game play records. Although the system disclosed in U.S. Pat. No. 6,241,606 effectively reuses previously distributed game play records, the system still closes a game before all lottery game play records are used, thus causing the overall results of the lottery game to vary from the lottery game design.

SUMMARY OF THE INVENTION

The present invention provides a method for electronically implemented lottery games that allows previously distributed but unused lottery game play records to be redistributed for use in response to future game play requests. The present invention also encompasses gaming systems and program products for implementing this gaming method.

As used in the remainder of this disclosure and the accompanying claims a "lottery game" or simply "game" will refer to a set of game play records having a predefined frequency of results at each of a number of different result levels/tiers. A player participates in, that is, plays a lottery game by purchasing a game play record included in the set of such records making up the lottery game. For example, a lottery game may include a total of 50,000 game play records with each result being included in one of six result levels and with each result level associated with a particular prize. Continuing with this example, the lottery game may include 5 game play records at the sixth and highest result level, 95 game play records at the fifth result level, 900 game play records at the fourth result level, 4000 game play records at the third result level, 25,000 game play records at the second result level, and finally 20,000 game play records at the lowest result level. A player plays this lottery game by purchasing one of the 50,000 game play records.

A method according to the present invention divides a lottery game into a number of distribution groups preferably at a central computer system. Each respective distribution group includes a number of game play records from the lottery game. For example, where a lottery game is made up of 50,000 game play records, a distribution group may include 5,000 game play records selected from the total set of 50,000. Two or more of these distribution groups are distributed to an assignment component included in the gaming system. This assignment component may comprise a player station in the gaming system, the central computer system, or some intermediate component between the central computer system and player station. The method assigns game play records from the distribution groups in response to the game play requests entered at the player stations. This process continues until, upon the occurrence of some collection condition, the unassigned game play records of the previously distributed distribution groups are collected and used to form one or more new distribution groups. These new distribution groups are distributed to an assignment component and then used just like the original distribution groups to satisfy game play requests.

In some preferred forms of the invention, the new distribution groups are each formed according to a game play record allocation requirement that defines some standard that the new distribution group must meet before being finalized and distributed for use in satisfying game play requests. For example, the game play record allocation requirement may require a minimum payout from the new distribution group, a minimum frequency of potential results (result levels) in the lottery game, and/or at least a minimum frequency for higher level results. Also, some forms of the invention may allow unassigned game play records from a second lottery game, or even a number of other games to be combined with collected, unassigned game play records from a first lottery game to produce a new distribution group of game play records.

A gaming system embodying one form of the invention includes a central computer system, a game play record distribution component, a game play record assignment component, and a game play record collection component. A suitable data storage device associated with the distribution component stores the original distribution groups produced for a lottery game. The distribution component distributes two or more of the distribution groups to the game play record assignment component included in the system. The game play record assignment component assigns game play records from the two or more distribution groups of game play records in response to game play requests entered at one or more player stations serviced by the game play record assignment component. The game play record collection component collects unassigned game play records from the two or more distribution groups and forms one or more new distribution groups from collected unassigned game play records. These new distribution groups may then be distributed to assignment components in the system by the game play record distribution component.

The present invention uses previously distributed but unassigned game play records to produce new distribution groups that may be indistinguishable from the original distribution groups for a given lottery game in terms of payout, potential result frequency, and hold. By reusing previously distributed but unassigned game play in producing new distribution sets, substantially all of the game play records for a given lottery game may be sold, with the result that the actual payout and hold for a given game may substantially match the designed payout and hold for the game. That is, since all or substantially all of the game play records produced for a given lottery game may be used/sold according to the invention, the payout and hold from the lottery game remains essentially predetermined. These and other advantages and features of the invention will be apparent from the following description of the preferred embodiments considered along with the accompanying drawings.

DESCRIPTION OF PREFERRED EMBODIMENTS

The present invention will be described initially below with reference to an implementation using a particular arrangement of hardware and data structures. This implementation includes a hardware arrangement similar to that described in U.S. Pat. No. 6,733,385 issued on May 11, 2004. The entire content of U.S. Pat. No. 6,733,385 is incorporated herein by this reference. However, it will be appreciated that the present invention is by no means limited to this particular arrangement of hardware, the methods implemented in the hardware, or the example data structures described below. Numerous variations on this implementation are possible within the scope of the present invention.

Figure 1:
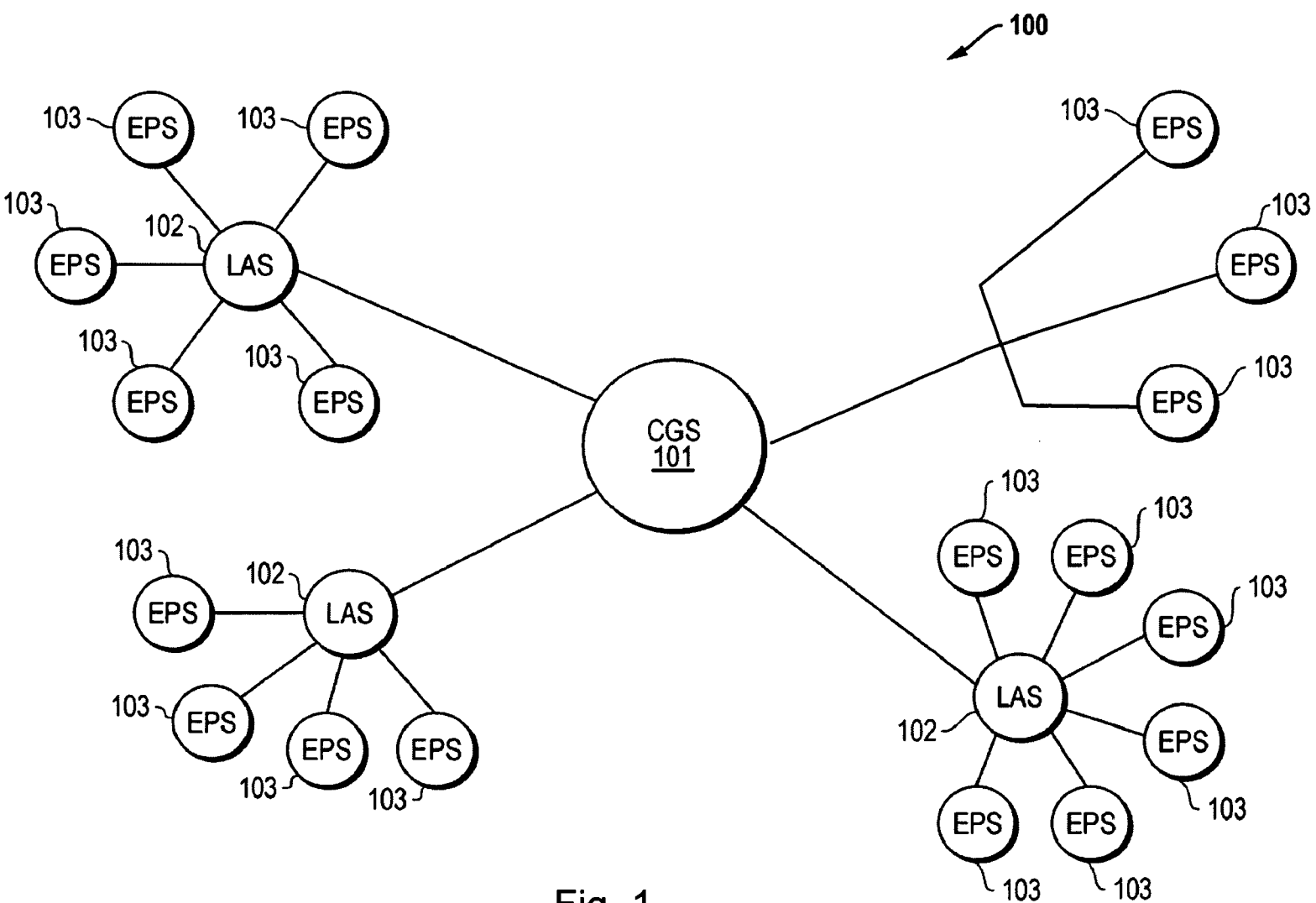
FIG. 1 is a high level diagrammatic representation of a gaming system embodying the principles of the present invention.

FIG. 1 shows a gaming system 100 including a central game server (CGS) 101 that cooperates with other components to enable players, preferably at many different remote gaming sites, to participate in lottery games. As will be discussed in further detail below, CGS 101 may include a component for creating lottery games and dividing the lottery games into distribution groups according to the invention. CGS 101 may also include a game play record distribution component for distributing the distribution groups to a game play record assignment component responsible for assigning game play records to players participating in the lottery games. CGS 101 may further implement a game play record collection component for collecting unassigned game play records from the previously distributed distribution groups.

Players participate in lottery games offered through system 100 by entering game play requests at any one of a number of electronic player stations (EPSs) 103 included in the system. Some gaming sites in the illustrated system include a local area server (LAS) 102 and a number of player stations 103. However, some gaming sites include simply one or more player stations 103 which communicate directly with CGS 101. The gaming sites may comprise dedicated gaming facilities (casinos) or retail establishments such as convenience stores depending upon the regulatory environment under which the lottery games are operated.

A lottery result for a game play request is presented to the player at a player station 103. Each lottery result correlates to a result defined by a respective game play record that is assigned for the game play request. The game play request defining the result may either be selected at the player station 103 itself, or by a system component separate from the respective player station 103 from which the game play request was initiated. In one preferred embodiment, a player station 103 implements a game play record assignment component which selects a respective game play request from a distribution group for that respective player station. In this case, one or more distribution groups of lottery tickets may be stored at the respective player station 103. In other preferred embodiments, the game play record assignment component is implemented through an intermediate component such as an LAS 102 which may store one or more distribution groups from which game play records may be assigned in response to game play requests originating from one or more player stations 103 serviced by the respective LAS. In still other embodiments, the game play record assignment component may be implemented at CGS 101.

Upon the occurrence of some collection condition, a game play record collection component which may be implemented at CGS 101 collects unassigned lottery tickets from the assignment component to which one or more distribution groups have been distributed for satisfying game play requests. These collected, unassigned game play records are used to form a new distribution group of game play records. The game play record distribution component may then send the new distribution group to a player station 103, LAS 102, or other device implementing an assignment component. Game play records may then be assigned from this "new distribution group" to satisfy incoming game play requests. The designation "new distribution group" may be used in this disclosure to distinguish between a distribution group of game play records that has been created from collected, unassigned game play records and an original distribution group created from game play records that have never before been distributed in a group of game play records made available for satisfying game play requests in a gaming system.

CGS 101 and each LAS 102 included in system 100, as shown in FIG. 1, may comprise one or more computer systems each having one or more processors, nonvolatile memory, volatile memory, a user interface arrangement for a system operator, and communications interface, all connected to a system bus. Although additional processing component details are shown and discussed in connection with FIG. 3, much of these computer system components are omitted from the present drawings and discussion so as not to obscure the present invention in unnecessary detail. Where CGS 101 and LASs 102 include general purpose computer systems, memory accessible by the respective computer system will store operation program code which may be executed by the respective computer processor to direct the various functions performed by the respective system.

It will be appreciated that the particular configuration of devices shown in FIG. 1 is shown only for purposes of example. A gaming system according to the present invention may omit some or all of the separate LAS's 102 at the various gaming facilities so that the player stations 103 communicate directly with CGS 101 as shown at the upper right of FIG. 1. Also, various regions or different gaming facilities may be divided up into separate systems each having a respective CGS such as CGS 101. A system according to the invention may also be configured such that any one of several different CGSs could service a given player station 103 anywhere in the system.

Figure 2:
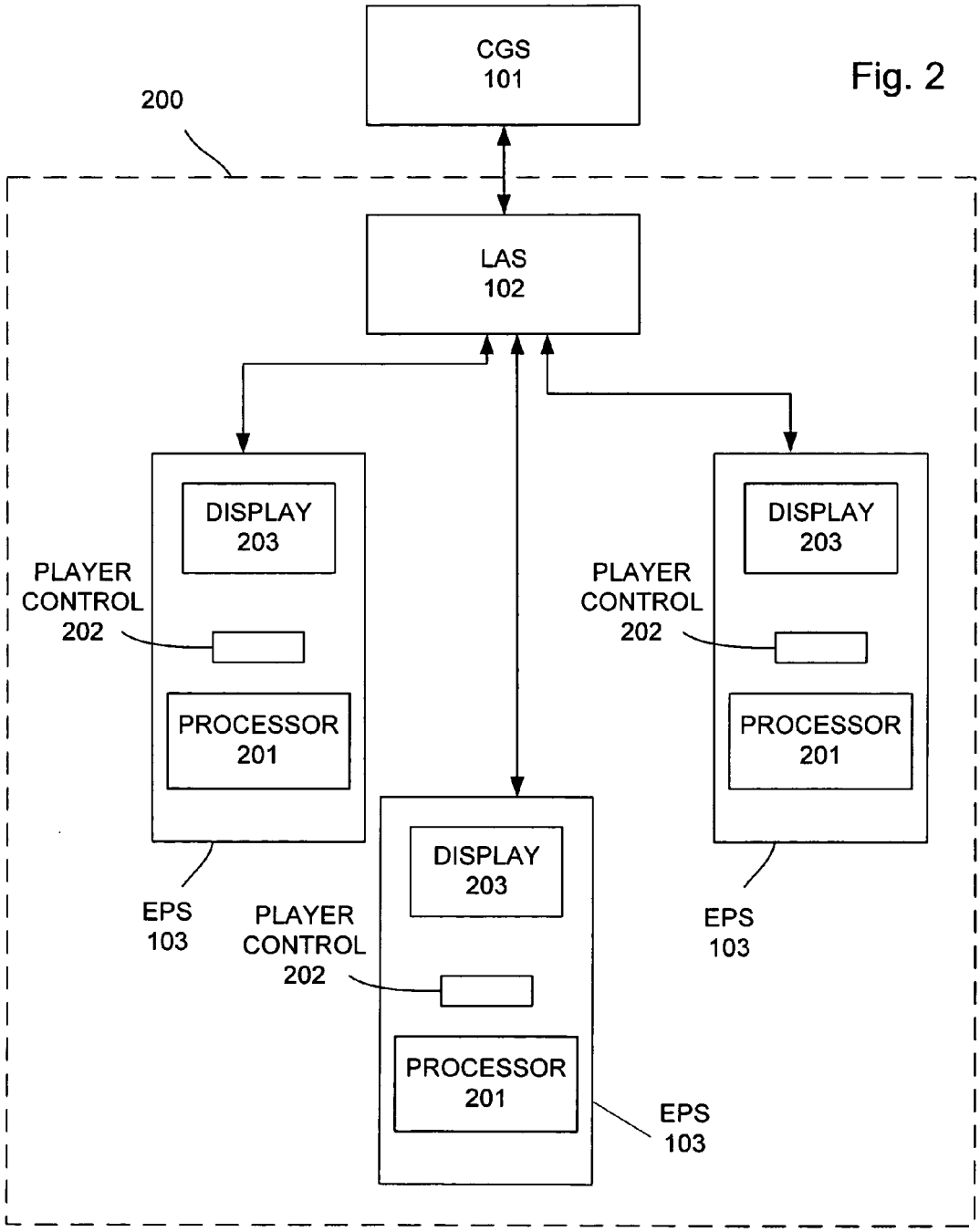
FIG. 2 is a diagrammatic representation of a portion of the system shown in FIG. 1.

FIG. 2 shows an individual gaming site 200 of the complete system 100 shown in FIG. 1. The illustrated gaming site 200 includes a single LAS 102 with several player stations 103 operatively connected for communications with the LAS. Player stations 103 of FIG. 2 are each illustrated as having a processor 201 and a user interface arrangement including a player control arrangement 202 and display 203. Although not shown separately in the drawing, processor 201 may be associated with volatile and nonvolatile memory and a communications interface. The processor 201 in a respective player station 103 may store program code that may be executed by the processor to cause the processor to perform or direct the various functions provided by player station 103. In particular, processor 201 will receive various player inputs from the player control arrangement 202 associated with the respective player station 103. Processor 201 also directs the respective display 203 to generate or produce graphics consistent with a game play record that has been assigned for a given game play request. It will be noted that processor 201 may direct display device 203 either directly or through a separate graphics processor (not shown). Also, it should be noted that in some implementations of a player station 103, the inputs for a player such as an input to make a game play request and/or a wager input may be entered by someone other than the player of the lottery game, for example, by an attendant at a convenience store in which a player station 103 is located.

A player control arrangement 202 associated with a respective player station 103 may include any type of input arrangement. For example, player control arrangement 202 may include one or more push buttons, keys, or lever activated switches, for example. Also, the player control arrangement 202 may include a touch screen and thus be integrated with display 203. It will also be appreciated that a player station 103 that may be used in the present invention may include more than a single display. Thus, display 203 includes at least one video monitor/display such as a CRT, LCD, plasma, or other display device for displaying graphics in the course of game play.

It will be appreciated that FIG. 2 provides only a very diagrammatic representation of each player station 103 and does not show many elements that may be included in a player station 103. Further, the player stations 103 need not be identical throughout the system 100. Rather, there may be wide variations in the various components included in each Player station 103. The system shown in FIG. 2 is limited generally to show just the elements necessary or helpful in describing the present invention. Further elements that may be included in an actual player station are not shown so as not to obscure the present invention in unnecessary detail.

Examples of additional components that may be included with a player station 103 include a separate graphic processor for driving display 203, a sound system for providing high quality audio output at the player station 103, and a visual alerting device such as a light mounted at the top of the player station. Display 203 may also include or comprise a mechanical display arrangement such as an arrangement of slot machine style spinning reels or wheels. Also, those familiar with gaming machines will appreciate that each player station may include a device or arrangement of devices for accepting currency, tokens, and/or vouchers, and a device or arrangement of devices for dispensing currency, tokens, and/or vouchers as winnings. Although not shown in the drawings, each player station 103 may include an arrangement for receiving payments from a player and an arrangement for making payouts to the player. Payouts may be made using a coin or token dispensing arrangement included in player station 103. Alternatively, or in addition to a coin or token dispensing arrangement, player station 103 may include a printer (not shown) for printing a ticket or voucher showing the player's winnings or account value. The player may redeem this ticket through a game operator, for example, or the player may use the ticket in another gaming terminal. In yet other arrangements, wagers and winnings may be tracked through a suitable player account arrangement included in gaming system 100, and a player may redeem their account through a system cashier or through some other suitable account interface arrangement. Of course, any appropriate device for receiving and issuing value in games played according to the present invention may be used, and the device may even be completely separate from the player station 103. Furthermore, the various player stations 103 included in a system such as system 100 need not be the same throughout the system. There may be wide variations in displays, player interfaces, and other components included in each respective player station 103.

Figure 3:
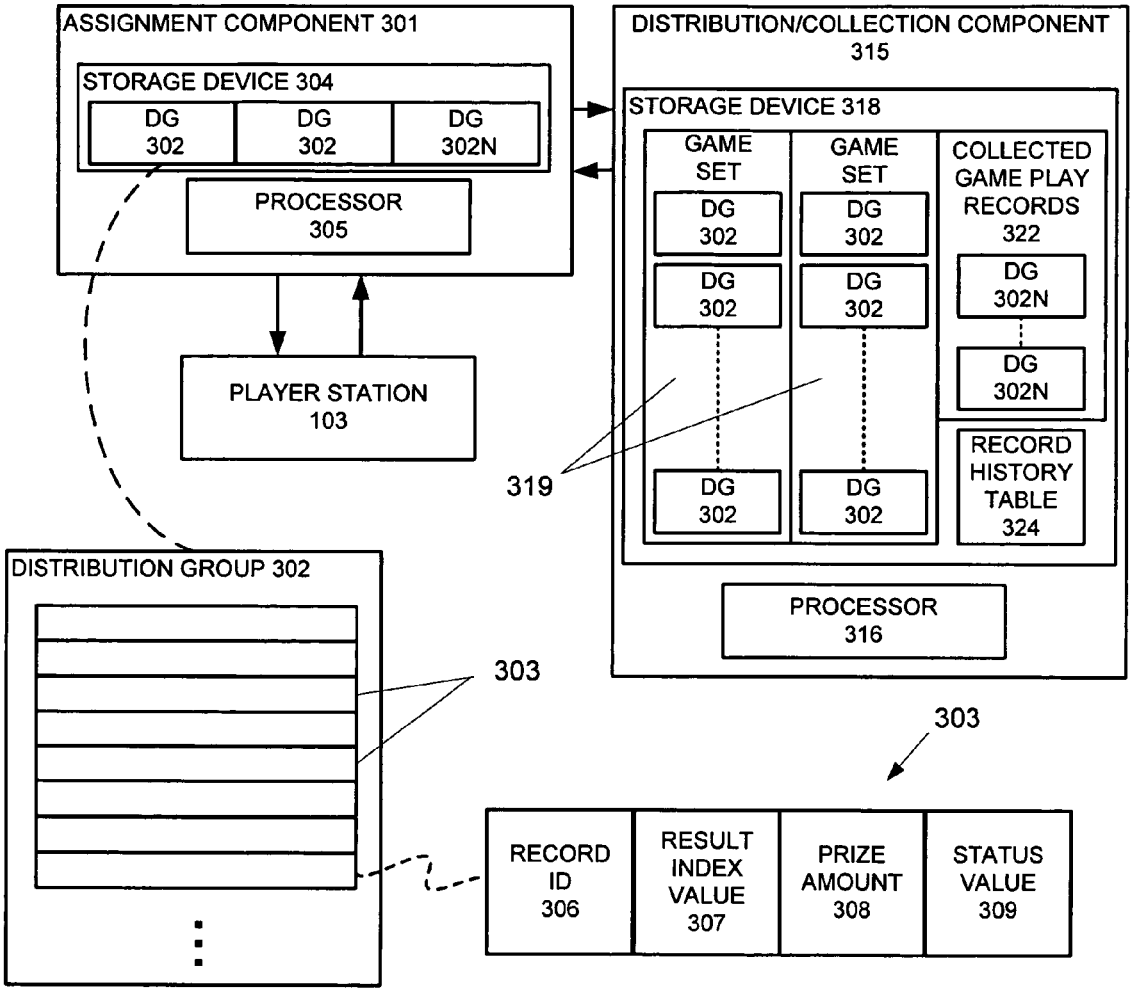
FIG. 3 is a diagram showing a distribution group structure and relationship between processing components in an embodiment of the invention.

FIG. 3 comprises a functional block diagram showing the interaction between a player station 103 as described above and the assignment component 301 of a gaming system embodying the principles of the invention. FIG. 3 may also be used to describe the interaction between a distribution/collection component 315 and assignment component 301.

Assignment component 301 includes an arrangement of elements for assigning game play records 303 from distribution groups 302 (and new distribution groups 302N as will be described further below). In particular, assignment component 301 includes a storage device 304 for storing preferably a number of distribution groups 302 and/or 302N, where each distribution group includes a number of game play records 303. Assignment component 301 also includes a processing device 305. As discussed above in connection with system 100 shown particularly in FIG. 1, assignment component 301 could be implemented through CGS 101, an LAS 102, a player station 103, or some combination of these components in system 100.

A distribution group 302, 302N according to the invention may be embodied in any suitable data structure. FIG. 3 simply shows a representation of a single data file as the distribution group 302, containing a number of individual game play records 303. However, other implementations may use multiple files to define a distribution group 302, 302N containing a number of game play records to be assigned to players. The invention is not limited to any particular form or structure for distribution groups 302, 302N or game play records 303.

The illustrated preferred game play record 303 includes a record identifier 306, a result index value 307, a prize amount 308, and a status value 309. These values in the game play record 303 are set when game play records 303 are first formed for the respective lottery game. It will be noted that since each game play record 303 is associated with a respective prize amount, each game play record is associated with a win/loss result for the lottery game. All game play records 303 are initially given a status value 309 of unassigned. This status can be indicated by a single bit of data and indicates that the game play record is unused, that is, that the game play record has not yet been assigned for a game play request. When a respective game play record 303 is assigned for a game play request, processor 305 associated with assignment component 301 causes the status value 309 of the assigned game play record 303 to be updated to an assigned/used status. With the status value 309 of the game play record 303 set to assigned/used status, the respective game play record 303 will not be available for assignment to an additional incoming game play request. Once set to an assigned/used status at field 309, the respective game play record 303 will also not be available for use in forming a new distribution group 302N according to the present invention as will be discussed further below. Only unassigned game play records 303 are available to form new distribution groups 302.

It will be appreciated that numerous other arrangements may be used to indicate which game play records 303 in a distribution group 302, 302N have been assigned for a game play request and which have not been so assigned. For example, one alternative arrangement maintains the assigned/unassigned status information for game play records of a distribution group in a separate data table. Also, game play records may be removed from a given distribution group as they are assigned so that the mere presence in a given data structure indicates that the game play record is unassigned. The invention encompasses any arrangement for distinguishing between assigned and unassigned game play records.

The structure shown in FIG. 3 for game play records 303 is shown only as a convenient example of a suitable game play record data structure. The invention is by no means limited to this data structure or any other particular data structure for game play records. Other types of data structures may include additional fields for data that is used in generating graphics to show the respective result. The game play record data structure shown in FIG. 3, however, represents a preferred form because it requires minimum data. Where this type of data structure is used for a game play record, the player station 103 may use either the result index value 307 or the prize amount 308 to identify a graphic display to be produced at the player station to show the player the particular result. This type of graphics control at the player station is described further in incorporated U.S. Pat. No. 6,733,385.

It will be appreciated that game play records 303 are preferably assigned randomly to satisfy game play requests. This randomization may be accomplished in any suitable fashion. One method for ensuring game play records 303 are assigned randomly is to randomize the order of game play records in the distribution groups 302 and then assign game play records sequentially from the randomized game play records of the distribution group. The second common method for ensuring game play records are assigned in random order is to randomly assign game play records from an ordered distribution group of game play records.

Rather than separate distribution and collection components, FIG. 3 shows a single distribution/collection component 315. The illustrated distribution/collection component 315 includes a processor 316 and a storage device 318 for storing game sets 319 of game play records. Each game set 319 makes up a respective lottery game and is divided into numerous distribution groups 302. Storage device 318 also stores unassigned game play records that have been previously included in a distribution group 302 that has been distributed to assignment component 301 and used to satisfy game play requests from one or more player stations 103. These unassigned collected game play records are shown collected in a file or other data structure 322. New distribution groups created from these collected and unassigned game play records are shown as distribution groups 302N stored at component 315. Processor 316 controls the operation of storage device 318 and directs or controls the various operations performed by distribution/collection component 315. In a preferred implementation of the invention, distribution/collection component 315 creates or receives lottery games divided into distribution groups 302 of game play records, distributes both original and reformed distribution groups (302 and 302N respectively) to assignment component 301, collects unassigned game play records from previously distributed distribution groups, and forms new distribution groups 302 from the collected, unassigned game play records. These operations, and particularly the creation of new distribution groups 302N from collected, unassigned game play records 303, will be described in further detail with reference to the flow chart of FIG. 4.

The example distribution/collection component 315 shown in FIG. 3 also maintains a record history data structure 324 at storage device 318. This record history data structure 324 is used to maintain a history for each game play record 303 used in the gaming system. This history may provide a complete audit trail for each game play record 303 and will be described further in connection with the flow chart of FIG. 4.

Those skilled in the art will appreciate that the invention may be embodied in many arrangements other than the illustrative arrangements shown in FIGS. 1, 2, and 3. For example, a single computer system may generate lottery games and may also store game play records from these lottery games for distribution to several player terminals such as player stations 103. Thus, a single computer system may implement a distribution component and assignment component. Distribution groups of game play records may also be stored at a respective player terminal for use in satisfying game play requests according to the invention. In this case, the player station 103 implements its own assignment component. In yet other arrangements within the scope of the present invention, a single computer system could perform the lottery game generation function, implement a distribution component, implement an assignment component which assigns game play records, and provides a player input and display, thus replacing the separate systems 101, 102, and 103 shown in FIGS. 1 and 2 and separate systems 103, 301, and 315 shown in FIG. 3. These alternative arrangements are to be considered equivalent to the arrangement shown in FIGS. 1, 2, and 3. In particular, it should be noted that although it is conceptually convenient to describe components in the present gaming system by their respective function (assignment component, distribution component, collection component), this description should not be taken to imply that these components are separate and discrete devices. Rather as indicated for example in FIG. 3 with respect to component 315, the components of a gaming system according to the present invention may be combined so as to be implemented by a common processing device. Furthermore, there may be wide variation within the scope of the present invention in the specific components included even in the basic arrangement of systems shown in FIG. 1. For example, LAS 102 may in fact be made up of several different processing systems rather than a single computer. In one preferred form of the invention, LAS 102 includes a separate processing device programmed to receive and respond to game play requests and a separate processing device programmed to implement databases for supporting the operation of the processing device which implements an assignment component for servicing game play requests, for example, a database to hold distribution groups from which game play records are assigned and to hold reserve distribution groups that are not currently being used to satisfy game play requests, but are readily available should additional game play records be required.

An assignment component according to the present invention such as assignment component 301 shown in FIG. 3 may implement a monitoring arrangement for monitoring for the occurrence of a collection condition for a given distribution group 302. The monitoring arrangement may be implemented by software executed by processor 305. When a collection condition occurs, such as the number of unassigned game play records 303 in a given distribution group 302 reaching some minimum value, the monitoring arrangement may communicate the partially used distribution group or at least the remaining unassigned game play records to a collection component such as the combined distribution/collection component 315 in FIG. 3 for collection with other unassigned game play records in data structure 322. The monitoring arrangement may additionally cause the assignment component to make a request to a respective distribution component for the gaming system to send one or more additional distribution groups of game play records. Further options and variations on a monitoring arrangement implemented at assignment component 301 or elsewhere in the system will be described below with reference to FIG. 4.

Figure 4:
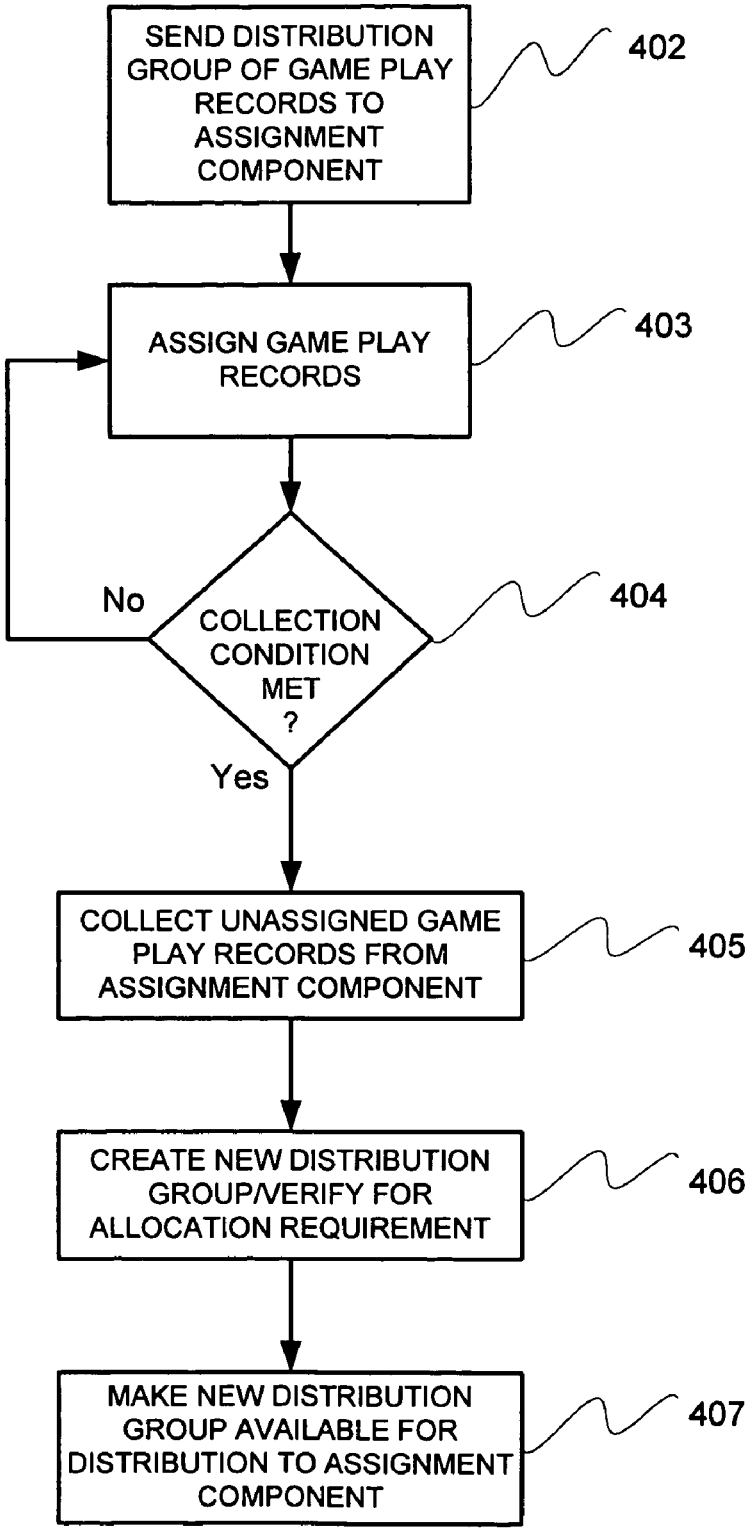
FIG. 4 is a flow diagram illustrating a gaming method embodying the principles of the present invention.

The flowchart shown in FIG. 4 may be used to describe preferred methods according to the present invention. It will be appreciated that the references to system components in the following method descriptions, and references to elements such as distribution groups 302, 302N and game play records 303 will be references to components and elements shown in FIG. 3, and that FIG. 4 does not itself show such components and elements.

As shown at process block 402 in FIG. 4, the invention includes sending distribution groups 302 of game play records 303 to an assignment component 301 which is responsible for assigning the game play records for game play requests. Game play records 303 are then assigned from the distribution groups at the assignment component 301 as shown at process block 403. Game play records 303 are assigned from a distribution group 302, 302N in the step indicated at block 403 until some collection condition is met for the distribution group. Once the collection condition is met as determined at decision block 404 in FIG. 4, unassigned game play records remaining in the distribution group 302, 302N are collected as indicated at process block 405. New distribution groups 302N are created from these collected, unassigned game play records 303 and game play records collected from other distribution groups as indicated process block 406, and these new distribution groups 302N are then made available for distribution to an assignment component 301 as shown that process block 407. The process then repeats for these new distribution groups 302N, with a new distribution group being sent to an assignment component 301 as shown at process block 402 and with game play records 303 then being assigned from the new distribution group as indicated at process block 403. Ultimately, once a collection condition is met for the new distribution group 302N, any unassigned game play records remaining in the new distribution group 302N are collected in the step indicated at process block 405 and another new distribution group is created from these unassigned game play records and other unassigned game play records that have been collected.

It will be appreciated that prior to the distribution of distribution groups 302 as indicated at process block 402, the original distribution groups must first be created in some suitable fashion. For example, a component may create a game set 319 of game play records 303 representing a lottery game, and then divide the game set into distribution groups 302. The component that creates such game sets may be separate from the present gaming system or included in the present gaming system. In some preferred forms of the invention, a game set may include a large number of game play records, such as 50,000 for example, and the distribution groups may include only a small fraction of this total number of game play records, 1000 to 5000 for example. However, it is possible within the scope of the invention that the distribution groups themselves may represent an entire game set for a lottery game. That is, it is not a requirement of the invention that original distribution groups 302 comprise only subsets of a larger set of game records making up a lottery game.

The original distribution groups 302 may each be formed from a random selection of game play records from the game set, or each of the original distribution groups may be formed to meet some standard or set of standards such as some predefined distribution of game play records from the game set. For example, original distribution groups may be formed so that each one includes a single game play record correlating to a grand prize, 10 game play records each correlating to second prizes, and so forth. However, a particular result distribution need not be predefined for an original distribution group. Rather, by selecting game play records for an original distribution group 302 at random from a game set, the original distribution group will naturally exhibit some mathematically determinable distribution of results based on the frequency of various results in the game set from which a distribution group may be created.

The step of sending distribution groups 302, 302N to an assignment component as indicated at process block 402 is preferably performed by a suitable distribution component which may be a separate component in a gaming system according to the invention or implemented with some other component such as the combined distribution/collection component 315 shown in FIG. 3. Regardless of what particular element in a system distributes distribution groups 302 and/or 302N to an assignment component such as component 301 in FIG. 3, the step preferably includes transmitting a file or other data structure that defines the game play records making up the distribution group.

The manner in which a distribution group 302, 302N may be sent to an assignment component as indicated at process block 402 will depend upon the particular architecture of the gaming system. For example, where a distribution component and assignment component are implemented in a single data processing device, the step of sending a distribution group to the assignment component may include moving the file or files representing the distribution group to a different storage location accessible to the data processing device or may simply include notifying the assignment component that the particular distribution group is available for use in assigning game play records. However, when the distribution component and assignment component are implemented in separate processing devices, such as in the arrangement shown in FIG. 3, some communication arrangement will generally be required to communicate the distribution group to the assignment component. The invention is not limited to any particular type of communication arrangement to facilitate communications between the distribution component and assignment component. The communication may be through any wired or wireless communication arrangement using any suitable communication protocol. It should also be noted that since the communication of distribution groups 320 and 302N from the distribution component to a given assignment component may need to be performed only at widely spaced times, a continuous communication arrangement between the distribution component and assignment component is not necessary. In particular, a communication connection between the distribution component and a given assignment component may be established only periodically in order to send distribution groups as indicated at process block 402.

Game play records are preferably assigned from a distribution group as indicated at process block 403 in response to a game play request initiated and a player station such as a player station 103 included in the gaming systems shown in FIGS. 1 through 3. The assignment of a game play record may involve a communication of information contained in the game play record to the player station at which the game play request was entered. The communicated information will at least be sufficient to allow the player station to identify the result and present the result to the player in some fashion. In some preferred forms of the invention, the assignment component 301 communicates only a result index value such as the value in field 307 in FIG. 3. However, in other implementations of the invention, the assignment of game play records may include sending to the player station additional data such as data defining specific graphics to be displayed. Of course, where the distribution group from which a game play record is assigned is already stored at the player station, the communication associated with the assignment of the game play record may simply comprise reading the required game play record data by the processing device at the player station. In any case, the assignment component such as component 301 in FIG. 3 utilizes some procedure for indicating when a game play record has been assigned/used so that game play records are assigned for a game play request only once, and so that only unassigned game play records remain available for use in creating new distribution groups 302N according to the step shown at process block 406 in FIG. 4. As discussed above with reference to FIG. 3, one preferred arrangement includes modifying a status field value associated with or included with a game play record to a status which represents that the game play record has been assigned/used. This may include simply toggling a bit in a status field such as field 309 shown in FIG. 3.

Determining whether a collection condition is met for a particular distribution group 302, 302N as indicated at decision block 404 in FIG. 4 may be performed in any suitable fashion. The particular actions required in this collection condition checking step will depend largely upon the nature of the collection condition. In some preferred forms of the invention, the assignment component has associated with it a monitoring arrangement that periodically compares a respective distribution group to a definition for the collection condition. This comparison may be performed by a processing device associated with the assignment component (such as processor 305 in FIG. 3 for example). The collection condition definition may be simply an elapsed time period or a time of day. For example, one or more distribution groups 302, 302N may be distributed from the distribution component (such as component 315 in FIG. 3) at the start of each day or other accounting period to one or more assignment components (such as component 301 in FIG. 3), and unassigned game play records from these distribution groups may then be collected at the end of the day or other accounting period. However, other forms of the invention may use other types of collection condition definitions. For example, a collection condition may be defined in terms of one or more characteristics of a distribution group 302, 302N from which game play records are being assigned. The number of unassigned game play records left in the group and the nature of the game play records left unassigned in the group, or both may be used to define a collection condition. For example, a collection condition may be defined as a state in which all of the game play records associated with higher result levels (e.g., grand prize, second level prize, third level prize) have been assigned from the distribution group leaving only game play records corresponding to lower level results available from the distribution group. Still other forms of the invention may define a collection condition as some minimum content of unassigned game play records corresponding to each result level in the lottery game. For example, collection condition may be defined as a distribution group makeup of less than X grand prizes, Y second level prizes, or Z third level prizes left for assignment in the distribution group. Regardless of the nature of the collection condition that is checked as indicated at process block 404 in FIG. 4, the collection condition may be checked for a given distribution group either on a continuous basis immediately after each game play record is assigned from the given distribution group or periodically in some fashion. Ultimately, if the collection condition is met for a given distribution group 302 or 302N, the process proceeds to process block 405. If the collection condition is not met, the process returns to process block 403 for assignment of further game play records from the distribution group 302, 302N.

The collection of unassigned game play records indicated at process block 405 is preferably performed by a separate collection component or a collection component that is combined with some other system component such as at the combined distribution/collection component 315 shown in FIG. 3. Where the collection component is implemented in a data processing system separate from the system implementing the assignment component, the collection of unassigned game play records will involve some communication from the assignment component to the collection component. For example, the collection step may include communicating the entire respective distribution group 302, 302N from the assignment component to the collection component. Alternatively, a collection step within the scope of the invention may include simply returning only the unassigned game play records 303 from a distribution group 302, 302N, that is, communicating only the unassigned game play records from the assignment component to the collection component. In still other forms of the invention, the collection component may maintain a replica of the distribution group file at the assignment component and this replica file may be updated as game play records are assigned from the distribution group so that the partially depleted distribution group at the assignment component need not be communicated to the collection component when the collection condition is met. Rather, the assignment component or other component responsible for checking for collection conditions may simply send a communication to the collection component indicating that the collection condition has been met and that unassigned game play records from the partially depleted distribution group 302, 302N are available for use in forming a new distribution group. The maintenance of a replica distribution group in this manner at the collection component may be considered "collecting" unassigned game play records within the scope of the present invention.

The collection component (such as the component embodied at component 315 in FIG. 3) preferably collects unassigned game play records in a manner that will assist or facilitate the creation of new distribution groups 302N according to the present invention. For example, where a new distribution group must meet some allocation requirement as described further below in connection with the process at block 406, the collection component may segregate the collected, unassigned game play records in a fashion that will be convenient for the creation of new distribution groups from such unassigned game play records. For example, the collection component may group collected, unassigned game play records (or some handle for each collected, unassigned game play record) by result level into some suitable data structure such as a series of queues. In other forms of the invention, game play records assigned to an original distribution group 302 may be kept together so that they are always selected for a new distribution group together. Generally, it will be preferable that the older collected, unassigned game play records be used first in the present gaming system to create new distribution groups 302N. That is, the collection component preferably collects unassigned/unused game play records so that the oldest game play records may be used to form a new distribution group 302N before younger game play records.

The step of creating a new distribution group 302N and verifying for an allocation requirement as indicated at process block 406 in FIG. 4 is conveniently performed by the processing device that implements the collection component (such as distribution/collection component 315 in FIG. 3). However, some preferred forms of the invention may separate the function of creating new distribution groups 302N and checking or verifying for an allocation requirement so that those functions are performed by a component separate from the collection component. In any event, the creation of new distribution groups 302N and verification for any allocation requirement may be performed in any suitable fashion. The specific steps in a given implementation will depend upon any allocation requirement for a new distribution group. For example, an allocation requirement for a new distribution group 302N may require that all game play records from any original distribution group must be maintained together and not separated into different subsequent distribution groups. In this case, the process of creating a new distribution group 302N selects groups of related game play records rather than separate game play records for producing the new distribution group. Also, an allocation requirement for a new distribution group may, for example, require a minimum distribution of result levels in the new distribution group. In this case, creating a new distribution group includes selecting collected, unassigned game play records according to their respective result levels. As indicated above in connection with the collection process shown at process block 405, this may be facilitated by collecting the unassigned game play results in queues by result level. Still other forms of the invention may simply select game play records that have been collected by the collection component up to a predetermined number of game play records and then reshuffle the game play records to produce the new distribution group. Reshuffling, that is, randomizing the new distribution group may not be necessary if the process of selecting collected, unassigned game play records for a distribution group itself produces randomness among game play records in the new distribution group. Also, as with the original distribution groups 302, randomness in the assignment of game play records may be accomplished by randomly assigning even ordered game play records in a new distribution group 302N.

The present invention also encompasses generating new distribution groups 302N using collected, unassigned game play records together with game play records that have not been distributed in a distribution group. For example, collected game play records may be added in to an original distribution group 302. In this case the collected game play records may be added randomly without regard to the result associated with the collected game play records, or they may be added to meet some allocation requirement for the resulting distribution group. In any case, where collected game play records are added to an original distribution group, the collected game play records may be shuffled at random locations in the original distribution group, added as a block of game play records at the beginning or end of the original distribution group, or incorporated into the original distribution group in any other suitable fashion.

It should be noted that there is no requirement in the present invention that game play records from a given lottery game only be grouped with other such records from that lottery game to form a new distribution group 302N. A new distribution group according to the invention may include game play records from two or more different lottery games. Where collected, unassigned game play records are added to an original distribution group for redistribution, the collected game play records may be added to an original distribution group for the same lottery game in which the collected game play records are included or for a different lottery game.

An allocation requirement according to the invention may be defined such that the resulting new distribution group will imitate an original distribution group for a given lottery game. For example, where original distribution groups for a given lottery game require a specific distribution of game result levels, the allocation requirement may be defined as that same distribution of game result levels. As another example, where there is no specific result level distribution required for an original distribution group, simply randomly selecting results for the original distribution groups will result in a natural characteristic result level distribution in the distribution groups. An allocation requirement within the scope of the invention may be defined as this natural result level distribution. This characteristic may be expressed as, for example, 0-1 grand prize results per m number of game play records in the distribution group, 0-3 second prize level results per m, 1-20 third prize level results per m, and so forth. In any case, requiring that the standard for an original distribution group 302 be equal or similar to the allocation requirement for a new distribution group results in the new distribution groups being indistinguishable from original distribution groups in terms of result level content.

It should also be noted that the invention does not require that each distribution group, either an original distribution group 302 or a new distribution group 302N, include the same number of game play records. For example, a new distribution group 302N created as indicated a process block 406 may include a number of game play records substantially less than the number of game play records included in an original distribution group 302. On the other hand, a new distribution group 302N may contain more game play records than an original distribution group.

The process of making a new distribution group 302N available for distribution to an assignment component as indicated at process block 407 preferably includes transferring or communicating the new distribution group from the component that created the new distribution group to the distribution component. Of course, where the distribution component and collection component are combined in common processing system as indicated by component 315 in FIG. 3, the step of making a new distribution group 302N available may include simply identifying the new distribution group as a distribution group that may be sent to an assignment component. Again, since older game play records are preferably used first in the gaming system, the distribution component may have a bias for distributing new distribution groups 302N to assignment components ahead of original distribution groups 302 that may be available for distribution.

The collection component that is responsible for collecting unassigned game play records as indicated at process block 405 and the component for creating new distribution groups, or some other component in the system, preferably maintains a history table such as the table shown above at reference numeral 324 in FIG. 3. This history table 324 stores data to indicate the history and each game play record created in the gaming system. History table 324 preferably includes information on the original distribution group 302 in which the game play record was included, and each subsequent distribution group 302N in which the game play record was included until it is ultimately assigned for a game play request. Such a history table may be important for regulatory and accounting purposes and may be used to produce statistics and final overall results (total payout, total hold, game play records sold and unsold, etc.) on each lottery game used in the gaming system. Of course, since of the present invention facilitates the use of substantially all game play records from a lottery game, the lottery game results may coincide exactly with the designed results from lottery game.

The above described preferred embodiments are intended to illustrate the principles of the invention, but not to limit the scope of the invention. Various other embodiments and modifications to these preferred embodiments may be made by those skilled in the art without departing from the scope of the invention.

The invention claimed is:

1. A method for using game play records in an electronic lottery game, the method performed by one or more controllers, the method including:

(a) forming a number of distribution groups for a gaming system, each respective distribution group including a number of game play records selected from a first lottery game comprising a first set of game play records having a predefined quantity of win or loss results at each of a number of different result levels for the first lottery game;

(b) distributing two or more of the distribution groups to assignment components included in the gaming system such that any one of the assignment components receives one or more of the distribution groups;

(c) assigning game play records from at least one of the two or more distribution groups, each assigned game play record being assigned in response to a respective game play request at a respective player station;

(d) collecting unassigned game play records from the two or more distribution groups of game play records; and (e) forming a new distribution group at a central computer system included in the gaming system, the new distribution group containing game play records from the collected unassigned game play records and containing at least one game play record from a second lottery game, the second lottery game comprising a second set of game play records having a predefined quantity of win or loss results at each of a number of different result levels for the second lottery game.

2. The method of claim 1 further including forming the new distribution group according to a distribution group game play record allocation requirement.

3. The method of claim 1 further including adding at least one game play record from a third lottery game to the new distribution group, the third lottery game comprising a third set of game play records having a predefined quantity of win or loss results at each of a number of different result levels for the third lottery game.

4. The method of claim 1 wherein each game play record from the second lottery game is a game play record that has been in a distribution group formed from the second set of game play records and has been distributed to a respective assignment component but remains unassigned.

5. The method of claim 1 further including forming the new distribution group according to a distribution group game play record allocation requirement which defines a number of a given win or loss result that is to be available from the new distribution group.

6. The method of claim 5 wherein the new distribution group is formed by selecting specific unassigned game play records from the collected unassigned game play records to meet criteria to replenish the game play records that have been assigned from one of the distribution groups.

7. The method of claim 1 further including distributing the new distribution group to a respective assignment component of the gaming system.

8. A gaming system including:

(a) a central computer system storing a number of distribution groups, the distribution groups each including a number of game play records selected from a first lottery game comprising a first set of game play records having a predefined quantity of win or loss results at each of a number of different result levels for the first lottery game;

(b) a game play record distribution component for distributing two or more of the distribution groups from the central computer system;

(c) a game play record assignment component for assigning game play records from at least one of the two or more distribution groups, at least one game play record being assigned in response to each of a number of game play requests made in the gaming system; and (d) a game play record collection component for collecting unassigned game play records from the two or more distribution groups, and for forming a new distribution group containing game play records from the collected unassigned game play records and containing at least one game play record from a second lottery game, the second lottery game comprising a second set of game play records having a predefined quantity of win or loss results at each of a number of different result levels for the second lottery game.

9. The gaming system of claim 8 wherein the game play record collection component forms the new distribution group according to an allocation requirement.

10. The gaming system of claim 8 wherein the game play record collection component adds at least one game play record from a third lottery game to the new distribution group, the third lottery game comprising a third set of game play records having a predefined quantity of win or loss results at each of a number of different result levels for the third lottery game.

11. The gaming system of claim 8 wherein each game play record from the second lottery game is selected from a respective distribution group that has previously been distributed to the game play record assignment component or a different game play record assignment component in the gaming system.

12. The gaming system of claim 8 wherein the game play record collection component forms the new distribution group from a respective one of the distribution groups from which game play records have been assigned.

13. The gaming system of claim 12 wherein the game play record collection component uses specific unassigned game play records to replenish the game play records that have been assigned from the respective one of the distribution groups.

14. The gaming system of claim 8 wherein the game play record collection component distributes the new distribution group to a respective assignment component in the gaming system.

15. A program product stored on at least one non-transitory storage medium, the program product including machine-readable instructions that when executed by one or more controllers are configured to:

(a) form a number of distribution groups at a central computer system of a gaming system, each distribution group including a respective number of game play records selected from a first lottery game comprising a first set of game play records having a predefined quantity of win or loss results at each of a number of different result levels for the first lottery game;

(b) distribute two or more of the distribution groups from the central computer system;

(c) assign game play records from at least one of the two or more distribution groups of game play records, each game play record being assigned in response to a respective game play request entered in the gaming system;

(d) collect unassigned game play records from the two or more distribution groups of game play records; and (e) form a new distribution group at a component of the gaming system, the new distribution group containing game play records from the collected unassigned game play records and containing at least one game play record from a second lottery game, the second lottery game comprising a second set of game play records having a predefined quantity of win or loss results at each of a number of different result levels for the second lottery game.

16. The program product of claim 15 wherein the machine-readable instructions further include instructions that when executed are configured to form the new distribution group according to a game play record allocation requirement.

17. The program product of claim 15 wherein the machine-readable instructions further include instructions that when executed are configured to add at least one game play record from a third lottery game to the new distribution group, the third lottery game comprising a third set of game play records having a predefined quantity of win or loss results at each of a number of different result levels for the third lottery game.

18. The program product of claim 15 wherein each game play record from the second lottery game is selected from a respective distribution group from which one or more game play records have previously been assigned.

19. The program product of claim 15 further including machine-readable instructions that when executed are configured to form the new distribution group using specific unassigned game play records to replenish the game play records that have been assigned from a respective one of the distribution groups.

20. The program product of claim 15 further including machine readable instructions that when executed are configured to distribute the new distribution group to an assignment component of the gaming system.

* * * * *